US010056058B2

(12) United States Patent
Hsu et al.

(10) Patent No.: US 10,056,058 B2
(45) Date of Patent: Aug. 21, 2018

(54) DRIVER AND OPERATION METHOD THEREOF

(71) Applicant: Au Optronics Corporation, Hsinchu (TW)

(72) Inventors: Cheng-Hsien Hsu, New Taipei (TW); Yung-Shu Lin, Miaoli County (TW)

(73) Assignee: Au Optronics Corporation, Hsinchu (TW)

( * ) Notice: Subject to any disclaimer, the term of this patent is extended or adjusted under 35 U.S.C. 154(b) by 106 days.

(21) Appl. No.: 15/259,034

(22) Filed: Sep. 7, 2016

(65) Prior Publication Data

US 2017/0200432 A1 Jul. 13, 2017

(30) Foreign Application Priority Data

Jan. 12, 2016 (TW) ..... 105100760 A

(51) Int. Cl.
*G09G 5/10* (2006.01)
*G09G 5/36* (2006.01)
*G09G 5/00* (2006.01)

(52) U.S. Cl.
CPC ..... *G09G 5/363* (2013.01); *G09G 5/006* (2013.01); *G09G 2300/0404* (2013.01); *G09G 2300/0408* (2013.01); *G09G 2300/0426* (2013.01); *G09G 2310/08* (2013.01); *G09G 2330/026* (2013.01);
(Continued)

(58) Field of Classification Search
CPC ..... G09G 5/363; G09G 5/395; G09G 5/397; G09G 5/36; G09G 5/22; G09G 5/006; G09G 2300/0408; G09G 2300/0426; G09G 2310/08; G09G 2330/026; G09G 2330/12; G09G 2370/04; G09G 2370/10; G09G 2300/0404; G09G 2300/04; G09G 2300/00; G09G 2300/0421; G09G 2310/00; G09G 2330/00; G09G 2370/00
See application file for complete search history.

(56) References Cited

U.S. PATENT DOCUMENTS 6,629,172 B1 9/2003 Andersson et al.
7,430,259 B2 9/2008 North et al.
(Continued)

FOREIGN PATENT DOCUMENTS

CN 102394043 3/2012
CN 102509532 6/2012
(Continued)

*Primary Examiner* — Julie Anne Watko
(74) *Attorney, Agent, or Firm* — JCIPRNET

(57) ABSTRACT

A driver includes a plurality of driver chips and an operation method thereof are provided. Each of driver chips includes a first transmission interface, a second transmission interface and a third transmission interface. The driver chips are coupled to each other by the first transmission interfaces and the second transmission interfaces, and the third transmission interfaces are commonly coupled to a parameter source to receive a plurality of operation parameters during an operation initiating period. When an abnormal signal is not returned after receiving the operation parameters, the driver chips end the operation initiating period. When the abnormal signal is returned after receiving the operation parameters, the driver chips receive the operation parameters again.

17 Claims, 4 Drawing Sheets

(52) U.S. Cl.
CPC ..... *G09G 2330/12* (2013.01); *G09G 2370/04* (2013.01); *G09G 2370/10* (2013.01)

(56) References Cited

U.S. PATENT DOCUMENTS

| | | | | |
|---|---|---|---|---|
| 7,634,611 | B2 * | 12/2009 | Hidai | H04L 12/407 710/310 |
| 8,205,017 | B2 * | 6/2012 | Parr | G06F 13/37 340/9.1 |
| 8,812,760 | B1 * | 8/2014 | Bamford | G06F 5/065 710/110 |
| 9,082,364 | B2 | 7/2015 | Lin et al. | |
| 2007/0024904 | A1 | 2/2007 | Baer et al. | |
| 2008/0252576 | A1 * | 10/2008 | Chuang | G09G 3/3611 345/87 |
| 2013/0044089 | A1 * | 2/2013 | Chang-Chian | G06F 3/1431 345/204 |
| 2013/0093742 | A1 * | 4/2013 | Lin | G09G 3/3688 345/211 |
| 2013/0113777 | A1 * | 5/2013 | Baek | G09G 3/20 345/212 |
| 2013/0124763 | A1 | 5/2013 | Kessler | |
| 2014/0281079 | A1 * | 9/2014 | Biskup | G06F 13/4022 710/110 |
| 2017/0277586 | A1 * | 9/2017 | Ito | G06F 11/079 |

FOREIGN PATENT DOCUMENTS

| | | |
|---|---|---|
| CN | 102654967 | 9/2012 |
| TW | 201317956 | 5/2013 |
| TW | I490842 | 7/2015 |

* cited by examiner

DRIVER AND OPERATION METHOD THEREOF

CROSS-REFERENCE TO RELATED APPLICATION

This application claims the priority benefit of Taiwan application serial no. 105100760, filed on Jan. 12, 2016. The entirety of the above-mentioned patent application is hereby incorporated by reference herein and made a part of this specification.

BACKGROUND OF THE DISCLOSURE

Field of the Disclosure

The disclosure relates to a driving method, and relates particularly to a driver and an operation method thereof.

Description of Related Art

Currently, a majority of the market integrates a timing controller and a data driver into a same chip, which is referred to as an integrated chip (iChip). The integrated chip may reduce the complexity and a circuit area of a printed circuit board assembly (PCBA) such that an overall weight of a panel is lighter, volume is smaller and a cost of the PCBA is lower.

However, along with an increase in resolution of display panels, if only a single integrated chip is adopted for a large sized panel, then a larger area of glass is required to execute impedance control since the impedance of the outputs of the integrated chip are different, leading to a larger border of the panel. Furthermore, high resolutions are restricted by the lengths of current IC manufacturing such that a distance between the output pins of the integrated chip are too small and is outside a machines' capable range for lamination. In addition, the single integrated chip will output a larger current for the larger panel to ensure a normal picture, causing a temperature of the integrated chip to over heat and generates display defects.

In view of the forgoing, how to develop multiple integrated-chips communication architecture to be applicable on the large size panel is an important issue.

SUMMARY OF THE DISCLOSURE

The invention provides a driver and an operation method thereof which may reduce a time of transmitting operation parameters.

The invention provides a driver, adapted to drive a display panel and including a plurality of driver chips. The driver ships are used to provide a plurality of pixel voltages to the display panel. Each of the driver chips includes a first transmission interface, a second transmission interface and a third transmission interface respectively. Wherein, the driver chips are serially connected to each other by the first transmission interfaces and the second transmission interfaces, and the third transmission interfaces are commonly coupled to a parameter source to receive a plurality of operation parameters during an operation initiating period. When an abnormal signal is not returned after the operation parameters are received, the driver chips end the operation initiating period. When the abnormal signal is returned after the operation parameters are received, the driver chips receive the operation parameters again.

The invention provides an operation method of a driver including the following steps, wherein the driver includes a plurality of driver chips, each of the driver chips includes a first transmission interface, a second transmission interface and a third transmission interface. The driver chips are serially connected to each other by the first transmission interfaces and the second transmission interfaces, and the third transmission interfaces are commonly coupled to a parameter source. The parameter source provides a plurality of operation parameters to the driver chips during an operation initiating period. The driver chips end the operation initiating period when an abnormal signal is not returned after the driver chips receive the operation parameters. The driver chips receive the operation parameters again when the abnormal signal is returned after the driver chips receive the operation parameters.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
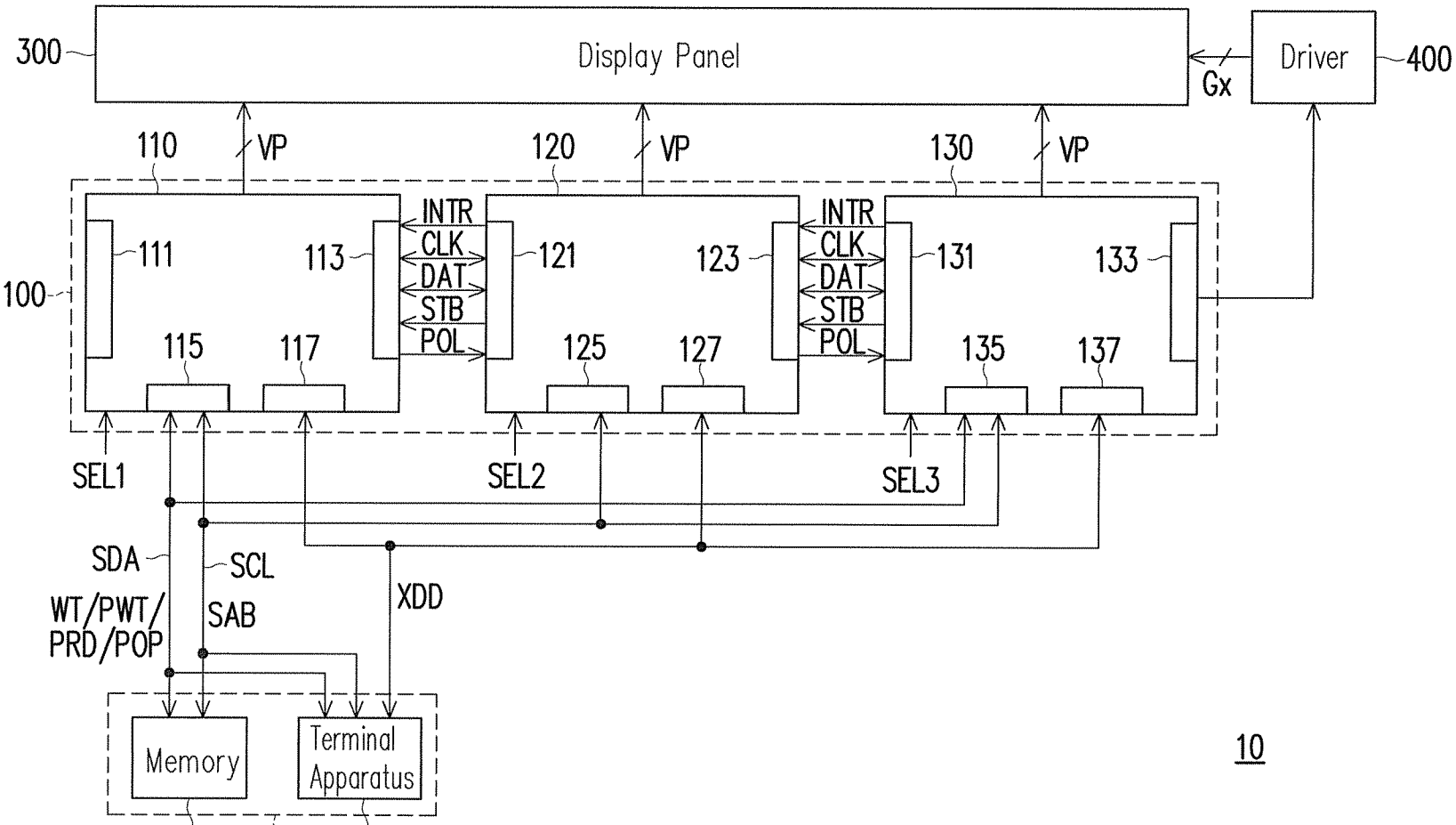
FIG. 1 is a schematic diagram illustrating a system of a display apparatus according to an embodiment of the invention.

Reference will now be made in detail to the present preferred embodiments of the disclosure, examples of which are illustrated in the accompanying drawings. Wherever possible, the same reference numbers are used in the drawings and the description to refer to the same or like parts.

FIG. 1 is a schematic diagram illustrating a system of a display apparatus according to an embodiment of the invention. Referring to FIG. 1, in the present embodiment, a display apparatus 10 includes drivers 100 and 400, a parameter source 200 and a display panel 300, wherein the parameter source 200 includes a memory 210 and a terminal apparatus 220, and the driver 400 may be a gate driver or a gate on array (GOA) on a substrate. The driver 100, then, is an integrated chip (iChip), and the integrated chip is an integrated circuit which includes a timing control unit, a data driving unit and a power driving unit. The drivers 100 and 400 are electrically connected to the display panel 300, and are used to drive the display panel 300, wherein the integrated chip 100 is used to provide a plurality of pixel voltages VP to the display panel 300, and the driver 400 is used to provide a plurality of gate signals Gx to the display panel 300.

The driver 100 includes driver chips (3 driver chips 110, 120 and 130 are used as an example), wherein the driver chips 110, 120 and 130 are coupled to the display panel 300 to provide the pixel voltages VP to the display panel 300. Each of the driver chips 110, 120 and 130 includes a first transmission interface, a second transmission interface, a third transmission interface and a fourth transmission interface respectively. More specifically, the driver chip 110 includes a first transmission interface 111, a second transmission interface 113, a third transmission interface 115 and a fourth transmission interface 117. The driver chip 120 includes a first transmission interface 121, a second transmission interface 123, a third transmission interface 125 and a fourth transmission interface 127. The driver chip 130 includes a first transmission interface 131, a second transmission interface 133, a third transmission interface 135 and a fourth transmission interface 137. The first transmission interfaces, the second transmission interfaces, the third transmission interfaces, and the fourth transmission interfaces are different kind of transmission interfaces and individual with other kind transmission interfaces. in this embodiment, the first transmission interfaces and the second transmission interfaces are interface control board (iCB) interfaces, the third transmission interfaces are inter-integrated circuit (I2C) interfaces or serial peripheral interfaces (SPIs), and the fourth transmission interfaces are image data transmission interfaces.

The driver chips 110, 120 and 130 are serially connected to each other through the first transmission interfaces 121, 131 and the second transmission interfaces 113, 123. The driver chips 110, 120 and 130 are commonly coupled to the parameter source 200 through the third transmission interfaces 115, 125, 135. The driver chips 110, 120 and 130 are commonly coupled to the terminal apparatus 220 through the fourth transmission interfaces 117, 127, 137. The driver chips 110, 120 and 130 may determine the master-slave relationship of a master driver chip (master IC) and a slave driver chip (slave IC) through external setting signals (such as SEL1, SEL2, SEL3) respectively. For example, when the driver chip 110 is set as the master driver chip through the SEL1, a data-read operation is executed with the parameter source 200, and then the others set as the slave driver chips 120 and 130 will monitor signals of the I2C bus line. During an initiating period, the memory 210 provides operation parameters POP to the driver chips 110, 120 and 130 sequentially, wherein the memory 210 may be controlled by a write command WT that is transmitted by the master driver chip 110 to provide the operation parameters POP, or the operation parameters POP may be provided proactively. After receiving these operation parameters POP, the driver chips 110, 120 and 130 will confirm whether the operation parameters POP received are correct, for example, the confirmation may be executed through a cyclic redundancy check (CRC). Wherein, the operation parameters POP may be used to set system parameters required for the operation of the driver chips 110, 120 and 130, and for example, may be image algorithm setting parameters, settings for the driver 400 parameter, the voltage levels of the gamma voltage, the size of the power voltage and the like. The image algorithm setting parameters for example are: content-adaptive backlight control algorithm, sunlight readable and such settings of the algorithm coefficients.

When the driver chips 110, 120 and 130 receive the operation parameters POP and an abnormal signal SAB is not returned to the master driver chip 110 within a predetermined time, it represents the driver chips 110, 120 and 130 have finished the initiating program, therefore the driver chips 110, 120 and 130 end the operation initiating period and prepare to display an image. After the driver chips 110, 120 and 130 receive the operation parameters POP and the abnormal signal SAB is returned within the predetermined time, the memory 210 will provide the operation parameters POP to the driver chips 110, 120 and 130 again, such that the driver chips 110, 120 and 130 receive operation parameters POP again. Wherein, the memory 210 may be a non-volatile read-write memory, for example, such as programmable read only memory (PROM), erasable programmable read only memory (EPROM), electrically erasable programmable read only memory (EEPROM) and the like.

For example, after the master driver chip 110 proactively reads the operation parameters POP in the memory 210, each of the driver chips will determine whether the read data is correct. When one of the driver chips 110, 120 and 130 discovers the data received is incorrect, then the driver chip (such as 110, 120 or 130) which discovered the incorrect data will pull a clock signal SCL in the third transmission interface 115 low. At this time the driver chip 110 will know there is incorrect data in the other driver chips, then will read the operation parameters POP from the memory 210 again. Wherein, the time which the clock signal SCL is pulled low may be greater than or equal to the transmission time of 2 bits. The aforementioned predetermined time may be the transmission time of 2 bits.

After the operation initiating period, the driver chips 110, 120 and 130 enter a normal operation period, namely the terminal apparatus 220 will provide display data XDD to the fourth transmission interfaces 117, 127, 137 of the driver chips 110, 120 and 130. At this time, the first transmission interfaces 121, 131 and the second transmission interfaces 113, 123 of the driver chips 110, 120 and 130 will enter bidirectional data transmission such that the driver chips 110, 120 and 130 mutually communicate, and the driver chips 110, 120 and 130 are connected together in series through the first transmission interface and the second transmission interface to form a serial transmission, wherein the first transmission interfaces of the driver chips 120 and 130 may receive data from the second transmission interfaces of the driver chips 110 and 120 respectively. As shown in FIG. 1, an interrupt signal INTR, the clock signal CLK and the data instruction signal DAT are used to confirm the display data XDD received by the driver chips 110, 120 and 130 to ensure multiple integrated chips execute directional transfer operations for image data, for example, when the driver chip 120 sends the interrupt signal INTR to the adjacent driver chip 130 to execute receiving of the display data XDD or a signal to synchronize each of the driver chips 110, 120 and 130 under a built-in-self-test (BIST) mode to ensure the display screen may display properly and the like. A latch signal STB is used to control an output time of the pixel voltages VP. A polar signal POL is used to determine the polarity of the pixel voltages VP. A direction of the interrupt signal INTR, the clock signal CLK, the data instruction signal DAT, the latch signal STB and the polar signal POL are as shown in the figure and will not be repeated here. In addition, the driver chip 130 may also trigger the driver 400 through the second transmission interface 133 to control the driver 400 to provide a plurality of sequentially enabled gate signals Gx to the display panel 300. The driver chip 130 may be the driver chip located at the last position in the series order.

In another embodiment of the invention, individual changes or reading of operation parameters POP of a register (not illustrated) in the driver chips 110, 120 and 130 may be executed when the image is displayed normally through the techniques of the invention. For example, when the display apparatus 10 executes the detection of the display signal of the display panel 300 again, a write or read command of the driver chips 110, 120 and 130 may be executed directly. In addition, the terminal apparatus 220 may be a computer, work station or a similar electronic device. Furthermore, the terminal apparatus 220 of an embodiment of the invention executes the write or read of the operation parameters POP of the register of the driver chips 110, 120 and 130 through the third transmission interfaces 115, 125, 135. Therefore, the data bus will not be shared with the display screen image processing data during the write or read process. As such, the time for transmitting data may be reduced and the storage space for temporarily storing the operation parameters POP by the driver chips 110, 120 and 130 may be reduced through the terminal apparatus 220 executing the write or read of the operation parameters POP of the register. In this way, the hardware cost of the driver chips 110, 120 and 130 may be reduced.

In the present embodiment, the parameter source 200 includes the memory 210 and the terminal apparatus 220, however in other embodiments, the parameter source 200 may be either one of the memory 210 or the terminal apparatus 220 and may be determined according to the requirements of a person skilled in the art and should not be construed as a limitation to the invention.

In the present embodiment, the first transmission interfaces 111, 121, 131 and the second transmission interfaces 113, 123, 133 may be control transmission interfaces, for example, an interface control board (iCB) interface. The third transmission interfaces 115, 125, 135 may be digital data transmission interfaces, for example, inter-integrated circuit (I2C) interfaces or serial peripheral interfaces (SPIs). The fourth transmission interfaces 117, 127, 137 may be image data transmission interfaces, for example, mobile industry processor interfaces (MIPI), or low-voltage differential signals (LVDS). The above are for description purposes and the embodiments of the invention are not limited hereto.

In an embodiment of the invention, the terminal apparatus 220 may further provide individual write commands PWT and individual read commands PRD. Here, the driver chips 110, 120 and 130 will enter a debug mode. When the driver chips 110, 120 and 130 receive the individual write command PWT, the corresponding driver chips (such as 110, 120 and 130) will receive the operation parameters POP provided by the terminal apparatus 220. When the driver chips 110, 120 and 130 receive the individual read commands PRD, the corresponding driver chips (110, 120 and 130) provide the operation parameters POP to the parameter source 200.

In an embodiment of the invention, when the third transmission interface 115, 125, 135 are inter-integrated circuit interfaces, the write command PWT may be transmitted through an address packet of the inter-integrated circuit interface. More specifically, using the controlling of 4 driver chips as an example, three address packets of 8 address packets may be used to represent over all control or individual control, one of the 8 address packets to represent the write or read and using the remaining address packets to represent it transmit a command or an address. The aforementioned example is for description purposes and the invention is not be limited thereto.

Using an address packet shown in the tables below as an example, suppose the driver chip 110 is the master driver chip and the driver chips 120 and 130 are the slave driver chips, when the 4 most significant bits of the address package are "0111" it represents that the address packet is transmitting a command. When the least significant bit of the address packet is "1" it represents writing. When the least significant bit of the address packet is "0" it represents reading. The remaining bits of the address packet represent the driver chip (such as 110, 120 and 130) to be written or read. For example, when the bits of the address packet are "0111_110_1", it represents write to all the driver chips (110, 120 and 130). When the bits of the address packet are "0111_000_1", it represents write to the driver chip 110. When the bits of the address packet are "0111_000_0", it represents read the driver chip 110. The remaining others may be understood from Table. 1 and Table. 2, and will not be repeated here.

TABLE 1

| | 0111_110_1 | 0111_000_1 | 0111_ 001_1 | 0111_010_1 |
|---|---|---|---|---|
| 110(Master) | ○ | ○ | X | X |
| 120(Slave) | ○ | X | ○ | X |
| 130(Slave) | ○ | X | X | ○ |

TABLE 2

| | 0111_110_0 | 0111_000_0 | 0111_001_0 | 0111_010_0 |
|---|---|---|---|---|
| 110(Master) | ○ | ○ | X | X |
| 120(Slave) | X | X | ○ | X |
| 130(Slave) | X | X | X | ○ |

Figure 2:
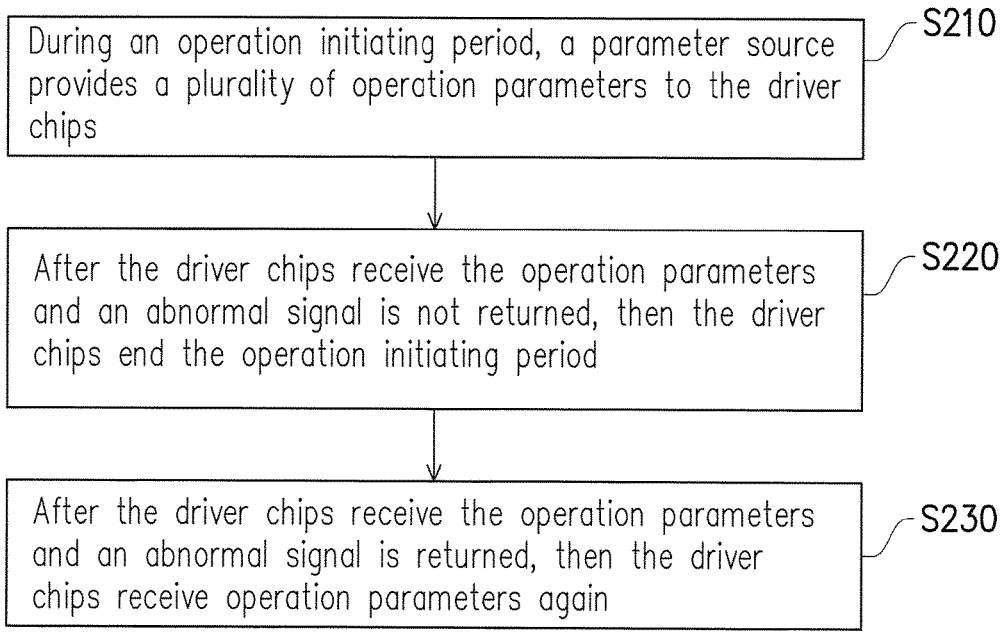
FIG. 2 is a flow diagram illustrating an operation method of a driver according to an embodiment of the invention.

FIG. 2 is a flow diagram illustrating an operation method of a driver according to an embodiment of the invention. Referring to FIG. 2, in the present embodiment, the driver includes a plurality of driver chips, wherein each of the driver chips includes a first transmission interface, a second transmission interface and a third transmission interface. The driver chips are connected together in series through the first transmission interfaces and the second transmission interfaces. The third transmission interfaces are commonly coupled to a parameter source. An operation method of a driver includes the following steps. In a step S210, during an operation initiating period, the parameter source provides a plurality of operation parameters to the driver chips. In a step S220, after the driver chips receive the operation parameters and an abnormal signal is not returned, then the driver chips end the operation initiating period. In a step S230, after the driver chips receive the operation parameters and an abnormal signal is returned, then the driver chips receive operation parameters again. Wherein, the order of the steps S210, S220 and S230 are for description purposes and should not be construed as a limitation to the invention. Furthermore, reference may be made to the embodiment of FIG. 1 for the specifics of the steps S210, S220 and S230 and will not be repeated here.

Figure 3:
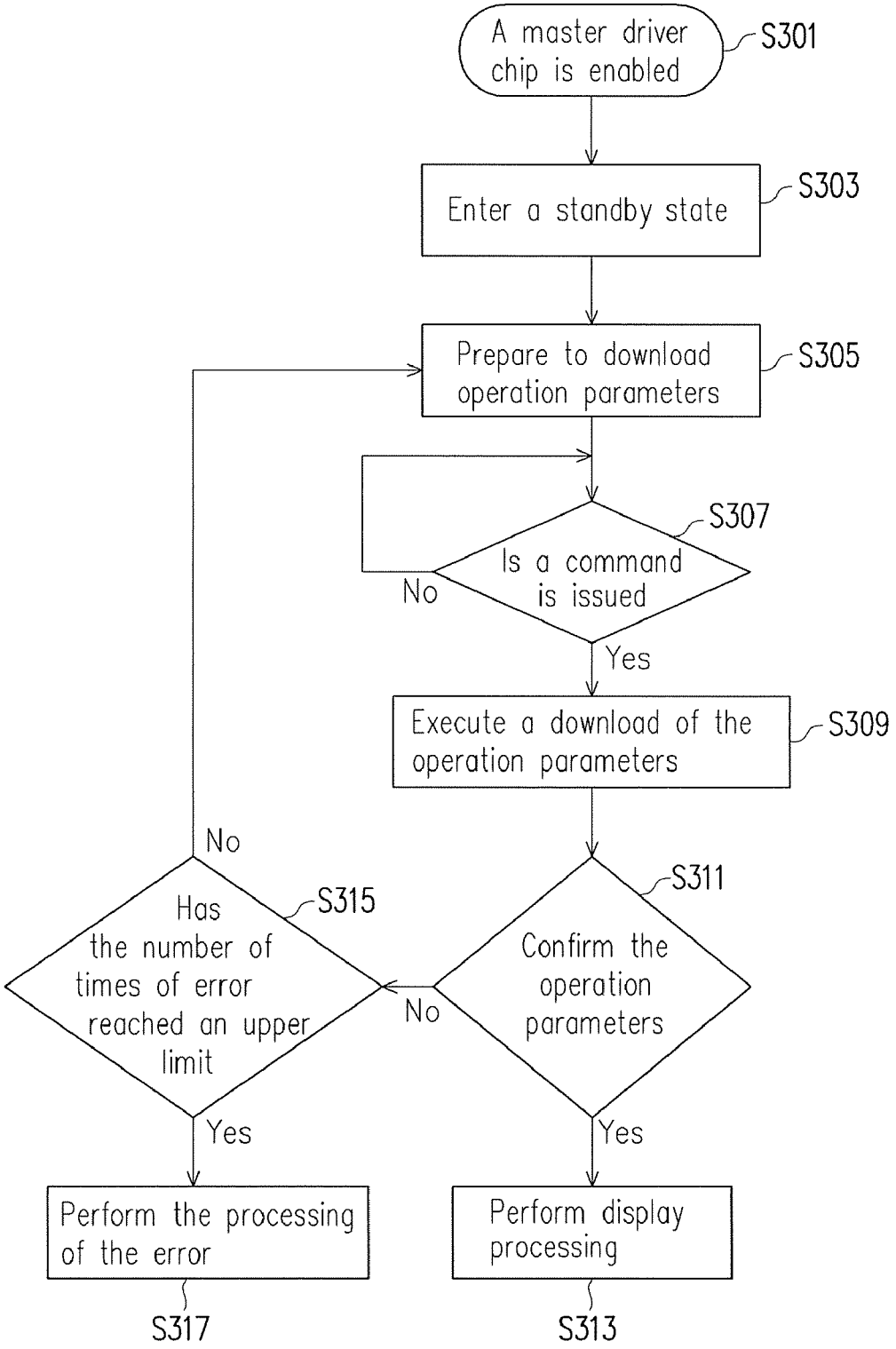
FIG. 3 is a flow diagram illustrating an operation method of a master driver chip according to an embodiment of the invention.

FIG. 3 is a flow diagram illustrating an operation method of a master driver chip according to an embodiment of the invention. Referring to FIG. 3, in the present embodiment, an operation method of a master driver includes the following steps. In a step S301, a master driver chip 110 is enabled. In a step S303, the master driver chip 110 enters a standby state to standby for the display apparatus 10 to be power ready. That is, the power unit (not shown) gets ready to output the power on sequence to the driver chips. In a step S305, the master driver chip prepares to download operation parameters. In a step S307, the master driver chip determines whether a command is issued. When a command is issued, namely the determination result is "yes", and then step S309 is executed. When a command is not issued, namely the determination result is "no", then return to step S307. In a step S309, the master driver chip executes a download procedure of the operation parameters. In a step S311, the master driver chip confirms whether the operation parameters are correct. When the operation parameters are correct, namely the determination result is "yes" and then step S313 is executed. When the operation parameters are incorrect, namely the determination result is "no", then step S315 is executed. In the step S313, the master driver chip will execute display processing. In the step S315, the master driver chip determines whether the number of times of error has reached an upper limit (5 times for example). When the number of error have reached the upper limit, namely the determination result is "yes", then step S317 is executed. When the number of error has not reached the upper limit, namely the determination result is "no", then return to step S305 to execute the download again. In a step S317, the master driver chip will execute inaccuracy processing to notify a user/tester that an error has occurred in the driver.

Figure 4:
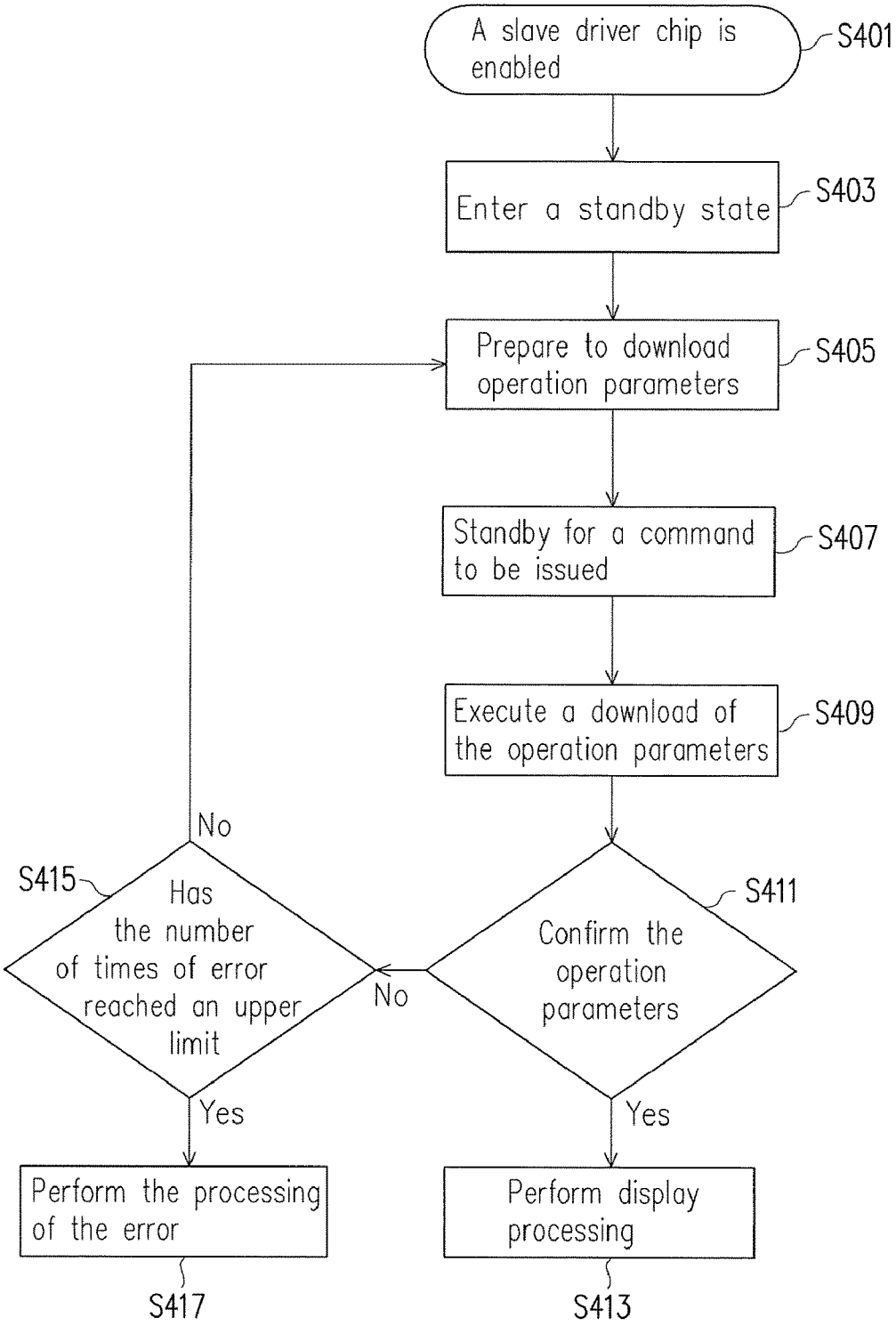
FIG. 4 is a flow diagram illustrating an operation method of a slave driver chip according to an embodiment of the invention.

FIG. 4 is a flow diagram illustrating an operation method of a slave driver chip according to an embodiment of the invention. Referring to FIG. 4, in the present embodiment, an operation method of a slave driver chip includes the following steps. In a step S401, the slave driver chip is enabled. That is, the power unit (not shown) gets ready to output the power on sequence to the driver chips. In a step S403, the slave driver chip enters a standby state to standby for the display apparatus to be power ready. In a step S405, the slave driver chip prepares to download operation parameters. In a step S407, the slave driver chip standby for a command is issued. In a step S409, when a command is issued, the slave driver chip executes a download of the operation parameters. In a step S411, the slave driver chip confirms whether the operation parameters are correct. When the operation parameters are correct, namely the determination result is "yes", then step S413 is executed. When the operation parameters are incorrect, namely the determination result is "no", then step S415 is executed. In the step S413, the slave driver chip will execute display processing. In the step S415, the slave driver chip determines whether the number of times of error has reached an upper limit (5 times for example). When the number of error have reached the upper limit, namely the determination result is "yes", then step S417 is executed. When the number of error has not reached the upper limit, namely the determination result is "no", then return to step S405 to execute the download again. In a step S417, the slave driver chip will execute the processing of the incorrect to notify a user/tester that an error has occurred in the driver.

In the embodiments of FIG. 3 and FIG. 4, all of the operation parameters are downloaded in one segment, however in other embodiments, the operation parameters may be downloaded in separate segments, namely, a cycle of the steps S305, S307, S309, S311, S315, S317 may be executed repeatedly between the steps S311 and S313, and a cycle of the steps S405, S407, S409, S411, S415, S417 may be executed repeatedly between the steps S411 and S413. In addition, the number of repetitions may be determined according to the circuit design and it should not be construed as a limitation to the invention.

In summary, in a driver and an operation method of a driver of the embodiments of the invention, operation parameters of a driver chip are received from a parameter source directly. In this way, a time for transmitting the operation parameters may be reduced. In addition, since the operation parameters do not need to be transmitted, hence the driver chip may conserve storage space for temporarily storing the operation parameters, namely the hardware cost of the driver chips may be reduced.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A driver, adapted to drive a display panel, comprising:
a plurality of driver chips, being used to provide a plurality of pixel voltages to the display panel, each of the driver chips comprising a first transmission interface, a second transmission interface and a third transmission interface respectively,
wherein the driver chips are serially connected to each other by the first transmission interfaces and the second transmission interfaces,
the third transmission interfaces are commonly coupled to a parameter source to receive a plurality of operation parameters during an operation initiating period, and
when an abnormal signal is not returned after the operation parameters are received, the driver chips end the operation initiating period,
when the abnormal signal is returned after the operation parameters are received, the driver chips receive the operation parameters again.

2. The driver as claimed in claim 1, wherein when a master driver chip of the driver chips transmits a write command, the parameter source provides the operation parameters to the driver chips sequentially.

3. The driver as claimed in claim 2, wherein the master driver chip is determined by a master-slave setting signal received by the driver chips respectively.

4. The driver as claimed in claim 2, wherein when the driver chips receive an individual write command, a corresponding driver chip receives the operation parameters provided by the parameter source.

5. The driver as claimed in claim 2, wherein when the driver chips receive an individual read command, a corresponding driver chip provides the operation parameters to the parameter source.

6. The driver as claimed in claim 2, wherein the third transmission interface is an inter-integrated circuit interface and the write command is transmitted by an address packet.

7. The driver as claimed in claim 2, wherein when the transmission of the operation parameters is completed and each of the driver chips did not receive the operation parameters correctly, then the driver chips pull a clock signal of the third transmission interface low to return the abnormal signal.

8. The driver as claimed in claim 1, wherein each of the driver chips further includes a fourth transmission interface commonly coupled to a host, wherein the fourth transmission interface receives a plurality of display data from the host and provides the corresponding pixel voltages of the plurality of pixel voltages to the display panel according to the display data.

9. The driver as claimed in claim 1, wherein the parameter source is at least one of a memory or a terminal apparatus.

10. An operation method of a driver, wherein the driver comprises a plurality of driver chips, each of the driver chips comprising a first transmission interface, a second transmission interface and a third transmission interface, the driver chips are serially connected to each other by the first transmission interfaces and the second transmission interfaces, and the third transmission interfaces are commonly coupled to a parameter source, the operation method of a driver comprising:
the parameter source providing a plurality of operation parameters to the driver chips during an operation initiating period;

the driver chips ending the operation initiating period when an abnormal signal is not returned after the driver chips receive the operation parameters; and the driver chips receiving the operation parameters again when the abnormal signal is returned after the driver chips receive the operation parameters.

11. The operation method of a driver as claimed in claim 10, further comprising:

the parameter source providing the operation parameters to the driver chips sequentially when a master driver chip of the driver chips transmits a write command.

12. The operation method of a driver as claimed in claim 11, wherein the master driver chip is determined by a master-slave setting signal received by the driver chips respectively.

13. The operation method of a driver as claimed in claim 11, further comprising:

when the driver chips receive an individual write command, a corresponding driver chip receives the operation parameters provided by the parameter source.

14. The operation method of a driver as claimed in claim 11, further comprising:

when the driver chips receive an individual read command, a corresponding driver chip provides the operation parameters to the parameter source.

15. The operation method of a driver as claimed in claim 11, wherein the first transmission interface is an inter-integrated circuit interface and the write command is transmitted by an address packet.

16. The operation method of a driver as claimed in claim 11, further comprising:

when the transmission of the operation parameters is completed and each of the driver chips did not receive the operation parameters correctly, then the driver chips pull a clock signal of the third transmission interface low to returned the abnormal signal.

17. The operation method of a driver as claimed in claim 10, wherein the parameter source is at least one of a memory or a terminal apparatus.

* * * * *